US005803773A

United States Patent [19]

Kashiyama et al.

[11] Patent Number: 5,803,773

[45] Date of Patent: Sep. 8, 1998

[54] CONNECTOR WITH REAR HOLDER

[75] Inventors: Motohisa Kashiyama; Toshifumi Suzuki, both of Shizuoka, Japan

[73] Assignee: Yazaki Corporation, Tokyo, Japan

[21] Appl. No.: 757,739

[22] Filed: Nov. 26, 1996

[30] Foreign Application Priority Data

Nov. 29, 1995 [JP] Japan ..... 7-310930

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 5,120,269 | 6/1992 | Endo et al | 439/752 |
| 5,316,504 | 5/1994 | Jinno | 439/752 |
| 5,567,184 | 10/1996 | Sasai et al. | 439/752 |

FOREIGN PATENT DOCUMENTS

| | | |
|---|---|---|
| 5-114432 | 5/1993 | Japan . |
| 5-36767 | 5/1993 | Japan . |

*Primary Examiner*—Gary F. Paumen
*Attorney, Agent, or Firm*—Sughrue, Mion, Zinn, Macpeak, & Seas, PLLC

[57] ABSTRACT

A connector includes a housing, a terminal accommodating chamber formed in the housing, an opening formed by removing a part of an upper plate of the housing, a rear holder, a hinge whose base portion is unitized with the housing and whose front end is unitized with the rear holder, a temporary retaining portion formed on an edge portion of the opening of the upper plate, a retaining plate portion formed on the rear holder to be retained by the temporary retaining portion, a temporary retaining claw formed on the rear holder, and a temporary retaining projection formed on the housing to allow the temporary retaining claw to be retained thereby.

11 Claims, 3 Drawing Sheets

CONNECTOR WITH REAR HOLDER

BACKGROUND OF THE INVENTION

1. Field of the Invention

This invention relates to a connector with a rear holder in which the rear holder for doubly retaining terminals accommodated in terminal accommodating chambers of a housing is arranged in the housing through hinges.

2. Background

Some connectors are designed so that retaining force thereof in the terminal pulling direction is improved by doubly retaining a terminal accommodated in a terminal accommodating chamber. One exemplary connector of this type is disclosed, e.g., in Unexamined Japanese Utility Model Publication No. Hei. 5-36767. This publication, which discloses one example of a connector having a rear holder for doubly retaining a terminal, the rear holder arranged on a housing through hinges, will be described with reference to FIGS. 5 and 6.

FIG. 5 is a sectional view showing a condition of a conventional connector with a rear holder before the rear holder is temporarily retained, and FIG. 6 is a sectional view showing a condition in which the rear holder of the connector of FIG. 5 has been temporarily retained. A plurality of terminal accommodating chambers 3 are formed in a housing 1. Each terminal accommodating chamber 3 has a retaining lance 5 arranged so as to prevent a terminal (not shown) from moving in a releasing direction. An opening 7 is formed over an outer peripheral surface in the rear of the housing 1. The opening 7 exposes the inside of each terminal accommodating chamber 3. A rear holder 9 is arranged on the opening 7 to be inserted into the opening 7. The rear holder 9 is unitized with the housing 1 through flexible hinges 11 formed in a band plate manner.

A terminal retaining portion 13 is formed on the lower surface of the rear holder 9, and a housing retaining portion 15 is formed on the front end of the rear holder 9. When the rear holder 9 has been inserted into the terminal accommodating chamber 3 from the opening 7, a terminal accommodated in a terminal accommodating chamber 3 is retained by the terminal retaining portion 13, and the housing retaining portion 15 is retained by the edge portion of the opening 7. Accordingly, the rear holder 9 is fixed to the housing 1 while doubly retaining the terminal in cooperation with the retaining lance 5.

By the way, a rising piece 17 projects from the rear end of the housing 1. A retaining claw 19 projects from a surface of the rising piece 17, the surface confronting the rear holder 9. Further, a retaining stepped portion 21 is formed on a surface of the rear holder 9, the surface confronting the retaining claw 19 of the rising piece 17. The retaining stepped portion 21 retains the retaining claw 19.

In the thus constructed conventional connector 23, the retaining claw 19 is retained by the retaining stepped portion 21 of the rear holder 9, so that the rear holder 9 is temporarily retained in the housing 7 as shown in FIG. 6. Therefore, the rear holder 9 no longer plays. Hence, even if a number of connectors 23 are transported in group under this condition, inconvenience such as the rear holders 9 of the connectors 23 being entangled with one another can be prevented.

However, the aforementioned conventional connector 23 is so constructed that the rear holder 9 is temporarily retained in the housing 1 by causing the retaining stepped portion 21 arranged on one end of the rear holder 9 to be retained by the retaining claw 19 of the housing 1. As a result of this construction, there has been a problem that the front end of the rear holder 9 opposite to the retaining stepped portion 21 moves away from the housing 1 and floats. If a number of such connectors 23 are transported in group under this condition, the rear holders 9 are entangled with one another due to their floating, or the rear holders 9 are entangled with one another due to their temporary retainment being released and the rear holders 9 therefore playing. When these rear holders 9 are disentangled, the hinges 11 may be deformed or broken, which in turn makes some connectors defective.

Further, in the conventional connector 23, the rear holder 9 and the hinges 11 are held so as to project from the housing 1 with the rear holder 9 temporarily retained. Therefore, during transportation, temporary retainment is easy to release by the rear holder 9 colliding with other connector and the hinges 11 are easy to deform or break by the hinges 11 colliding with other connector.

SUMMARY OF THE INVENTION

The invention has been made in view of the aforementioned circumstances. The object of the invention is therefore to provide a connector that allows a rear holder to be temporarily retained in the housing reliably without causing the rear holder to float from the housing, and prevents the rear holder and the hinges from projecting from the housing when the rear holder is temporarily retained to thereby prevent temporary retainment of the rear holder from being released and to thereby prevent the hinges from being broken.

To achieve the above object, the invention is applied to a connector, which includes a housing, a terminal accommodating chamber formed in the housing, an opening formed by removing a part of an upper plate of the housing so that a part of the terminal accommodating chamber is exposed, a platelike rear holder having a double retaining projection to be engageable with the terminal, a flexible hinge whose base portion is unitized with the housing and whose front end is unitized with the rear holder, a temporary retaining portion being formed on an edge portion of the opening of the upper plate, a retaining plate portion formed in the front of the rear holder and retained by the temporary retaining portion while inserted into a lower surface of the upper plate, a temporary retaining claw being formed in the rear of the rear holder, and a temporary retaining projection formed on the housing and retained by the temporary retaining claw. In the connector, the hinge is bent toward the inside of the housing and the retaining plate portion is retained by the temporary retaining portion, and further, the temporary retaining claw is retained by the temporary retaining projection, so that the rear holder is temporarily retained with the rear holder accommodated inside the opening.

In the thus constructed connector, the front and the rear of the rear holder are retained in the housing by the retaining plate portion and the temporary retaining claw when the rear holder is temporarily retained. Further, this retained condition is consolidated by the restitutive force of the hinge, which in turn allows the front and the rear of the rear holder to be retained in the opening reliably. Further, under this condition, the rear holder is retained inside the opening, and the hinge is accommodated in the housing, which in turn excludes the likelihood that the rear holder and the hinge project from the outer periphery of the housing.

DETAILED DESCRIPTION OF THE PREFERRED EMBODIMENTS

A connector, which is a preferred mode of embodiment of the invention, will now be described with reference to the drawings.

Figure 1:
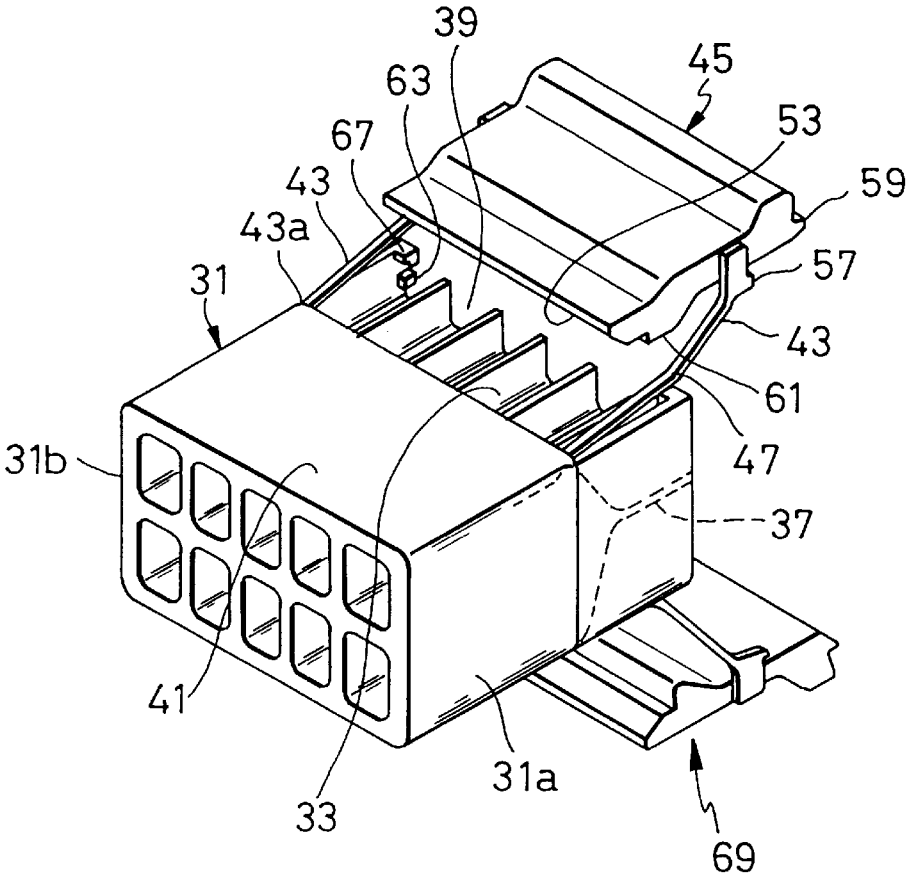
FIG. 1 is a perspective view showing a condition of a connector of the invention before a rear holder is temporarily retained.
Figure 2:
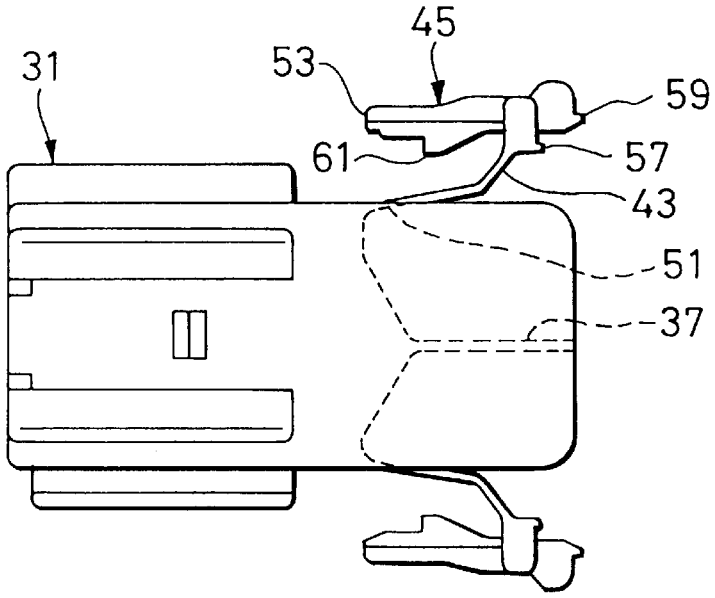
FIG. 2 is a side view showing a condition of the connector of FIG. 1 before the rear holder is temporarily retained.
Figure 3:
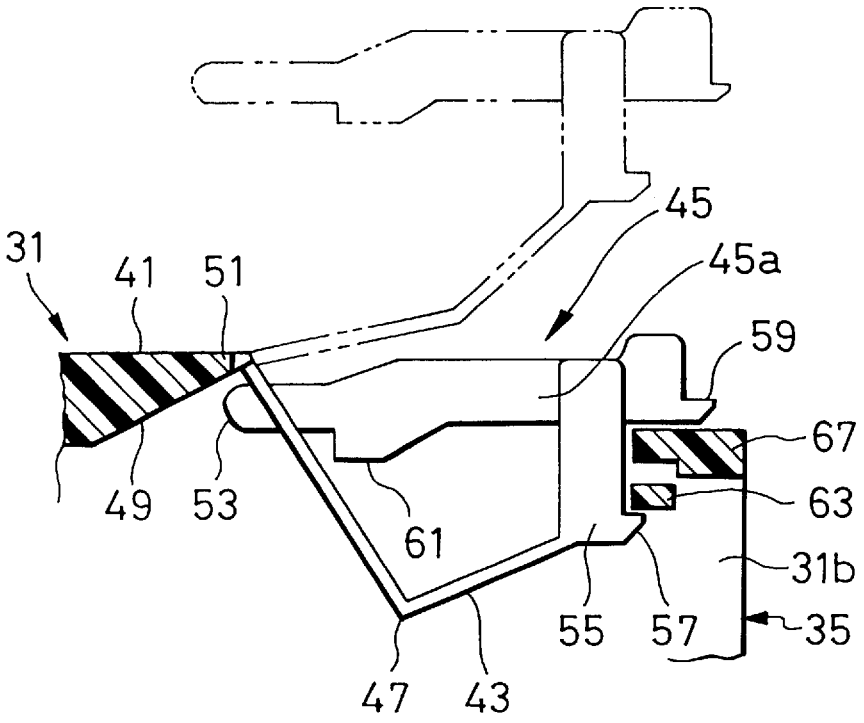
FIG. 3 is an enlarged view showing an important portion of a condition in which the connector of FIG. 1 is temporarily retained.
Figure 4:
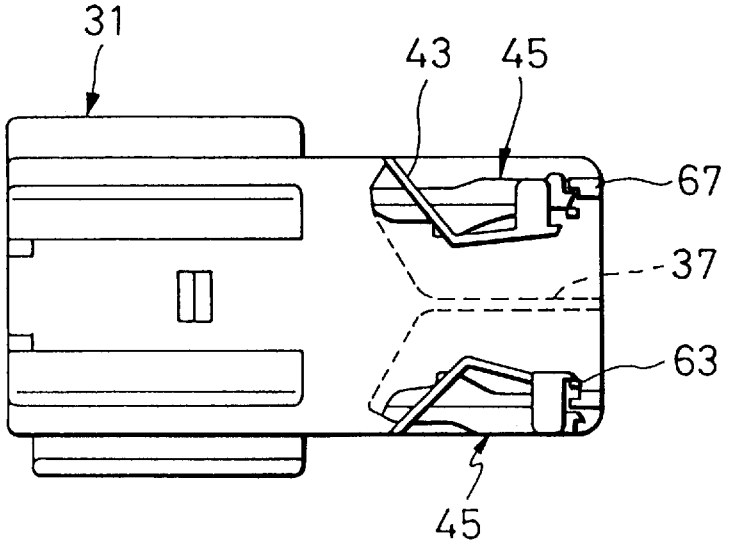
FIG. 4 is a side view of the connector in which the rear holder is regularly and temporarily retained.
Figure 5:
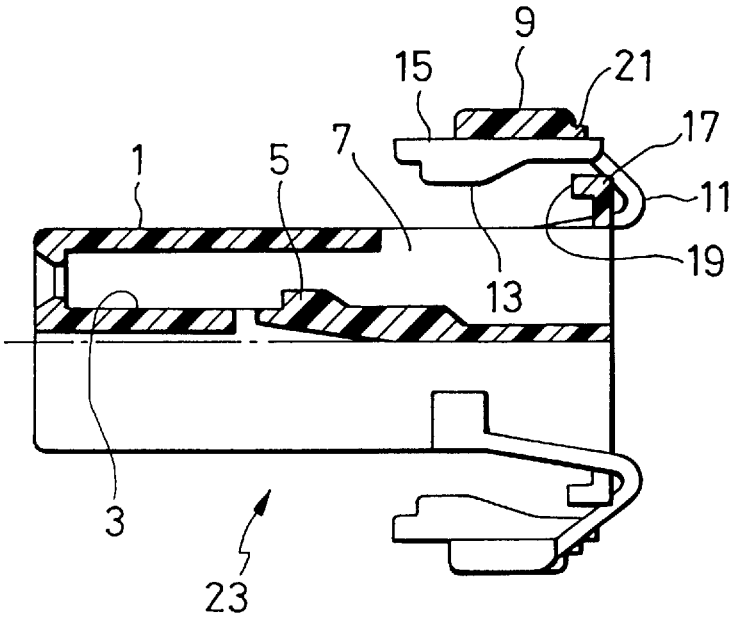
FIG. 5 PRIOR ART
FIG. 5 is a sectional view showing a condition of a conventional connector before a rear holder is temporarily retained.
Figure 6:
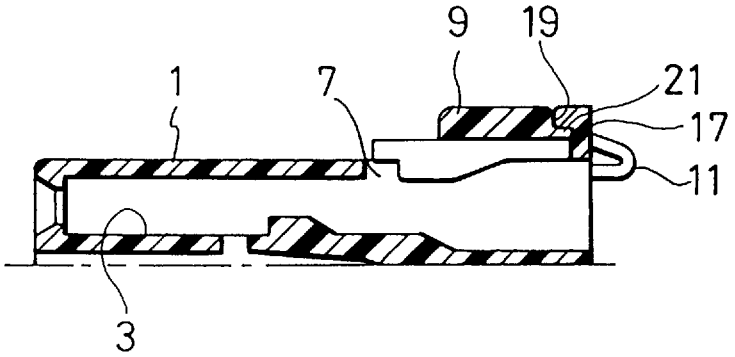
FIG. 6 PRIOR ART
FIG. 6 is a sectional view showing a condition in which the rear holder of the connector of FIG. 5 is temporarily retained.

FIG. 1 is a perspective view showing a condition of a connector of the invention before a rear holder is temporarily retained, FIG. 2 is a side view showing a condition of the connector of FIG. 1 before the rear holder is temporarily retained, FIG. 3 is an enlarged view showing an important portion of a condition in which the connector of FIG. 1 is temporarily retained, and FIG. 4 is a side view of the connector in which the rear holder is regularly and temporarily retained.

A plurality of terminal accommodating chambers 33 are juxtaposed in a housing 31. Each terminal accommodating chamber 33 has an opening in the rear end of the housing 31, the opening being a terminal insertion hole 35 in the rear of the terminal accommodating chamber (see FIG. 3). In the housing 31, a partition plate 37 is interposed between the upper and lower terminal accommodating chambers 33. The housing 31 is vertically symmetrical with respect to the partition plate 37. In order to avoid repetition, the upper portion of the housing 31 will be described below.

The housing 31 has an opening 39 over an upper rear portion thereof. The opening 39 exposes the inner rear portions of the juxtaposed terminal accommodating chambers 33. The opening 39 is formed by removing the rear portion of an upper plate 41 of the housing 31. Therefore, the rear end of the upper plate 41 is the edge portion of the opening 39. The base portions 43*a* of a pair of hinges 43 extend from the edge portion of the opening 39, i.e., the rear end of the upper plate 41. The pair of hinges 43 are arranged so as to be adjacent to side plates 31*a* and 31*b* of the housing 31 inside such side plates 31*a* and 31*b*, respectively. Each hinge 43 is made of a flexible band plate member and is unitized with the housing 31.

On the other hand, a plate-like rear holder 45, which has substantially the same shape as that of the opening 39, is arranged in the opening 39 to be inserted into the opening 39. Both side portions of the rear holder 45 are coupled to the front ends of the hinges 43. A bent portion 47 is formed in the middle of each hinge 43 as viewed in the longitudinal direction, so that the hinge 43 is turned about the base portion 43*a* and the bent portion 47 against elasticity when the base portion 43*a* and the bent portion 47 are elastically deformed. Therefore, when the rear holder 45 is inserted into the opening 39, the hinges 43 are accommodated in the housing while bent at the base portion 43*a* and the bent portion 47.

As shown in FIG. 3, a tapered surface 49 is formed on the lower surface of the upper plate 41 of the housing 31. The tapered surface 49 is such that the upper plate 41 is gradually thinned toward the rear end thereof. The tip of the tapered surface 49 (the rear end of the upper plate 41) serves as a temporary retaining portion 51. On the other hand, a retaining plate portion 53 is formed on the front end of the rear holder 45. The retaining plate portion 53 is such that a base plate portion 45*a* of the rear holder 45 is thin-walled. A pair of retaining pieces 55 are arranged on both side portions of the rear holder 45. From each temporary retaining piece 55 extends a retaining claw 57. The retaining claws 57 project toward the rear of the rear holder 45. Further, on both rear end sides of the rear holder 45 are regular retaining projecting claws 59. The regular retaining projecting claws 59 also project toward the rear of the rear holder 45. Further, doubly retaining projections 61 project from the lower surface of the rear holder 45. Each doubly retaining projection 61 is retained by a not shown terminal accommodated in the terminal accommodating chamber 33.

On the other hand, temporary retaining projections 63 are arranged so as to project toward the terminal accommodating chamber 33 from both inner sides of the side plates 31*a* and 31*b* of the housing 31. Further, regular retaining projections 67 are arranged so as to project from the side plates 31*a* and 31*b*. The regular retaining projections 67 are arranged above the temporary retaining projections 63 at an interval.

A procedure for temporarily and regular retaining the rear holder 45 of the thus constructed connector 69 will be described.

The rear holder 45 is retained in the housing 31 by squeezing the hinges 43 into the housing and inserting the retaining plate portion 53 in the front end of the rear holder 45 into the temporary retaining portion 51 in the rear end of the upper plate 41 of the housing 31.

The rear holder 45, whose retaining plate portion 53 on the front end has been inserted into the temporary retaining portion 51 of the upper plate 41, then allows the temporary retaining claws 57 arranged on the side plates 31*a* and 31*b* of the housing 31 to be retained by the temporary retaining projections 63.

Under this condition, the retaining plate portion 53 and the temporary retaining claws 57 are biased onto the temporary retaining portion 51 and the temporary retaining projections 63 by reaction caused by the flexion of the hinges 43, so that the rear holder 45 is reliably retained in the opening 39 (see the rear holder in the lower side of FIG. 4). Then, under this condition, the front end portion of the rear holder 45 is inserted into the lower surface side of the upper plate 41, further, the rear end portion thereof is accommodated in the opening 39, so that there is no portion projecting from the outer periphery of the housing 31. Further, at the same time, the hinges 43 are squeezed and accommodated into the housing 31, so that the there is no portion projecting from the outer periphery of the housing 31, either. As a result, the temporary retaining of the rear holder 45 has thus been completed.

Further, the rear holder 45 is regularly retained by squeezing the retaining plate portion 53 of the rear holder 45 in the temporarily retained position further toward the front of the housing along the tapered surface 49 of the upper plate 41 with a not shown terminal accommodated in the terminal accommodating chamber 33. As a result, the rear holder 45 causes the hinges 43 to be further bent, so that the rear holder 45 moves along the lower surface side of the upper plate 41, and allows the regular retaining projecting claws 59 in the rear to be retained by the regular retaining projections 67 on the housing 31 side, so that the rear holder 45 is regularly retained by the opening 39 (see the rear holder in the upper part of FIG. 4). Under this condition, the double retaining projection 61 projecting from the lower surface of the rear holder 45 is retained by the not shown terminal accommodated in the terminal accommodating chamber 33, which in turn regulates the movement of the terminal so as not to be released from the terminal accommodating chamber 33. Accordingly, the terminal can be doubly retained.

The connector 69 is designed so that the front and rear ends of the rear holder are retained in the housing 31 side through the retaining plate portion 53 and the temporary retaining claws 57 when the rear holder 45 is temporarily retained, and further the retained condition is consolidated by the restitutive force of the hinges 43. Therefore, the front and the rear of the rear holder 45 can be retained in the opening 39 reliably.

Further, the rear holder 45 has no portion thereof projecting from the outer periphery of the housing 31 under this condition. Further, the hinges 43 are also squeezed into the housing 31, which also eliminates portions projecting from the housing 31.

As described in the foregoing, according to the aforementioned connector 69, the front and the rear of the rear holder 45 are retained in the housing 31 by the retaining plate portion 53 and the temporary retaining claws 57, and the rear holder 45 is biased in the retaining direction by the restitutive force of the hinges 43 that are accommodated in the housing 31 while elastically deformed. Therefore, the rear holder 45 can be temporarily retained reliably, which in turn prevents the deformation and breakage of the hinges 43 caused by rear holders whose temporary retainment has been released being entangled with each other during transportation of connectors.

Further, in the temporarily retained condition, the rear holder 45 is retained so as not to project from the outer periphery of the housing 31, and the hinges 43 are accommodated inside the housing 31. Therefore, the temporary retainment of the rear holder 45 is not likely to be released through collision with other connector during transportation, and deformation and breakage of the hinges 43 caused by the hinges 43 projecting from the housing 31 colliding with other connector can be prevented.

While only the upper side of the housing 31 has been described in the aforementioned mode of embodiment, it goes without saying that the connector 69 can be formed so as to be vertically symmetrical by arranging the opening 39, the rear holder 45, the hinge 43, the retaining plate portion 53, the temporary retaining claws 57, and the like also on the lower side of the housing 31.

As described in the foregoing in detail, according to the connector of the invention, the front and the rear of the rear holder are retained in the housing through the retaining plate portion and the temporary retaining claws, and the rear holder is biased in the retaining direction by the restitutive force of the elastically deformed hinges. Therefore, the temporary retaining of the rear holder can be made reliable, which in turn prevents deformation and breakage of the hinges caused by the temporary retainment being released during transportation. In addition, in the temporarily retained condition, the rear holder is retained inside the opening, and the hinges are accommodated in the housing. Therefore, the rear holder and the hinges do not project from the outer periphery of the housing, which in turn prevents the releasing of the temporary retainment of the rear holder and breakage of the hinges caused by the rear holder and the hinges colliding with other connector.

What is claimed is:

1. A connector, comprising:

a housing;

terminal accommodating chambers, for accommodating terminals, formed in said housing;

an opening formed in an upper plate of said housing to expose a part of said terminal accommodating chambers;

a rear holder having a retaining projection engageable with a terminal placed within one of said terminal accommodating chambers;

flexible hinges having base portions unitized with said housing and front ends unitized with said rear holder;

a temporary retaining portion formed on an edge portion of said opening of said upper plate;

a retaining plate portion formed on a front portion of said rear holder, said retaining plate portion being retained by said temporary retaining portion while said retaining plate portion is inserted under a lower surface of said upper plate;

temporary retaining claws formed on a rear portion of said rear holder; and extending rearwardly therefrom; and temporary retaining projections formed on said housing, said temporary retaining projections retaining said temporary retaining claws, respectively;

wherein said hinges are disposed so as to bend toward an inside of said housing, said retaining plate portion is retained by said temporary retaining portion, said temporary retaining claws are retained by said temporary retaining projections, so that said rear holder is selectively retained temporarily inside said opening such that said rear holder does not interfere with insertion or withdrawal of the terminals.

2. The connector of claim 1, further comprising respective bent portions formed in the middle of said hinges in a longitudinal direction, wherein said hinges are accommodated inside the housing while said hinges are bent at said bent portions, and wherein said bent portions formed in the middle of the hinges are bent towards the inside of said housing such that when said retainer is selectively retained temporarily inside said opening said bent portions are located between vertical planes in which said temporary retaining portion and said temporary retaining projections are respectively located.

3. The connector of claim 1, further comprising retaining pieces formed on both sides of said rear holder, said retaining pieces projecting downwardly from said rear holder.

4. The connector of claim 3, wherein said temporary retaining claws are formed on said retaining pieces, respectively.

5. The connector of claim 4, wherein said temporary retaining claws rearwardly project from said retaining pieces.

6. The connector of claim 3, wherein said hinges are connected to said rear holder via said retaining pieces.

7. The connector of claim 1, further comprising:

regular retaining claws projecting rearwardly from said rear holder; and regular retaining projections formed on said housing, said regular retaining projections retaining said regular retaining claws, respectively.

8. The connector of claim 7, wherein said regular retaining projections project from both side plates of said housing, respectively.

9. The connector of claim 8, wherein said regular retaining projections are arranged above said temporary retaining projections at an interval.

10. The connector of claim 1, wherein said housing further comprises two side plates, and wherein said temporary retaining projections project from both side plates of said housing, respectively.

11. The connector of claim 1, wherein said temporary retaining portion includes a tapered surface.

* * * * *